United States Patent [19]

Lee

[11] Patent Number: 4,870,912

[45] Date of Patent: Oct. 3, 1989

[54] AUTOMATIC COMBUSTION CONTROL METHOD FOR A ROTARY COMBUSTOR

[75] Inventor: Suh Y. Lee, Monroeville, Pa.

[73] Assignee: Westinghouse Electric Corp., Pittsburgh, Pa.

[21] Appl. No.: 311,383

[22] Filed: Feb. 15, 1989

Related U.S. Application Data

[63] Continuation of Ser. No. 160,451, Feb. 25, 1988, abandoned.

[51] Int. Cl.[4] ..... F23N 5/02; F27B 7/38

[52] U.S. Cl. ..... 110/246; 110/190; 110/234; 432/105

[58] Field of Search ..... 110/186, 185, 188, 190, 110/203, 233, 234, 235, 246, 255, 257, 258, 297; 432/103, 116, 118; 236/15 E, 15 BD, 15 BB, 15 BR, 16

[56] References Cited

U.S. PATENT DOCUMENTS

| | | | |
|---|---|---|---|
| 3,822,651 | 7/1974 | Harris et al. | 110/246 X |
| 3,861,336 | 1/1975 | Koyanagi et al. | 110/246 |
| 4,066,024 | 1/1978 | O'Connor | 110/246 X |
| 4,226,584 | 10/1980 | Ishikawa | 110/246 |
| 4,279,208 | 7/1981 | Guillaume et al. | 110/188 X |
| 4,362,269 | 12/1982 | Rastogi et al. | 236/14 |
| 4,395,958 | 8/1983 | Caffyn et al. | 110/246 |
| 4,495,872 | 1/1985 | Shigaki | 110/190 |
| 4,724,778 | 2/1988 | Healy | 110/246 |
| 4,735,157 | 4/1988 | Jurusz | 110/246 |
| 4,782,766 | 11/1988 | Lee et al. | 110/190 |
| 4,782,768 | 11/1988 | Lee et al. | 110/246 |
| 4,782,769 | 11/1988 | Lee et al. | 110/246 |
| 4,793,269 | 12/1988 | Dezubay et al. | 110/246 |

FOREIGN PATENT DOCUMENTS

| | | | |
|---|---|---|---|
| 180212 | 10/1964 | Japan | 110/190 |

*Primary Examiner*—Henry C. Yuen

*Attorney, Agent, or Firm*—Michael G. Panian

[57] ABSTRACT

An improved method for automatically controlling rate of combustion in a rotary combustor having a rotating combustion barrel (11) by precisely controlling a supply of combustion gas to three separate combustion zones (A, B and C) of the combustion barrel (11) in the rotary combustor used for the incineration of municipal solid waste material (15), the combustion zones (A, B and C) have an associated windbox (34, 37 and 40) disposed directly beneath a respective combustion zone, the windboxes (34, 37 and 40) are further divided into an overfire air zone (36, 39 and 42) and an underfire air zone (35, 38 and 41) forming six air zones which are adjusted by a controller (51) to precisely regulate the supply of combustion gas to each of the six air zones (35, 36, 38, 39, 41, 42). The controller (51) responds to inputs from an oxygen sensor (25) disposed within a flue and a temperature sensing device (31) disposed within the combustion barrel (11) to maintain a percentage of oxygen present in the exhaust gas (21) within a predetermined range, the controller (51) also regulates the rate of rotation of the combustion barrel (11) in order to compensate for the varying nature of the solid waste material (15) to provide clean and efficient combustion.

13 Claims, 4 Drawing Sheets

AUTOMATIC COMBUSTION CONTROL METHOD FOR A ROTARY COMBUSTOR

This application is a continuation of application Ser. No. 07/160,451 filed Feb. 25, 1988, now abandoned.

TECHNICAL FIELD

The invention relates to a rotary combustor, for the incineration of wet or dry municipal solid waste material, and more particularly to an improved automatic combustion control method for the rotary combustor.

BACKGROUND OF THE INVENTION

Due to the shrinking available capacity in landfills for the disposal of solid waste, a corresponding reduction in the volume of municipal solid waste for such disposal has been pursued. The principal method used in this program is the incineration of combustible materials. Although such a program has shown to be successful in reducing the volume of municipal solid waste, as well as having the added advantage of producing energy, exhaust emissions from these plants need to be rigidly controlled so as to minimize the amount of carbon monoxide and unburned hydrocarbons emitted. Some states have set stringent requirements as to the amount of carbon monoxide allowed in exhaust emissions as well as a minimum oxygen level. Failure to meet these emission requirements could result in the shut down of the incinerator. By operating these incinerators more efficiently, more complete combustion will result and hence, exhaust emissions will satisfy the statutory requirements.

One type of incineration plant is known as a water-cooled rotary combustor. An example of such a combustor is described in U.S. Pat. No. 3,822,651 to Harris et al., which is incorporated herein by reference. A water-cooled rotary combustor generally includes a combustion barrel having a generally cylindrical side wall affixed to annular support bands which are received on rollers to permit rotation of the barrel about its longitudinal axis. The barrel has a generally open input end for receiving material to be burned, such as municipal solid waste which can vary in moisture content. The opposite or output end of the barrel is disposed in a flue. The combustion barrel is tilted from the horizontal, the input end being higher than the output end. As the waste material burns, it travels along the longitudinal axis of the barrel such that solid combustion products exit the barrel at the lower output end. Exhaust gases and solid combustion products exit the barrel at the output end. The combustion barrel is cooled by cooling pipes joined by gas porous interconnections to form the generally cylindrical side wall of the barrel.

Since the composition of the waste material varies, it can be difficult to maintain a constant feed rate of the solid waste into the barrel, and thus the intensity of the fire varies over time. Also, the heat of combustion of solid waste for each input charge into the combustor varies greatly. As a result, the constitution of the exhaust gases can also vary over time. By controlling the rate of combustion within the barrel, a more efficient incineration occurs and produces a more stable constitution of the exhaust gases and less unburned hydrocarbons. More particularly, it is important to maintain the carbon monoxide level below 100 ppm since that is the level required by most State laws. Another requirement imposed on the operators of municipal waste incinerators is that the oxygen level in the exhaust gases not fall below 3%.

A method for automatic combustion control for a rotary combustor is described in pending application Ser. No. 018,682, filed on Feb. 25, 1987, of which applicant is a co-inventor and which is assigned to the present assignee. An oxygen sensor located within the flue is used to detect the percentage of oxygen present in the exhaust gases. The output from this sensor is used to control the amount of combustion gas supplied to the combustion barrel in order to maintain a percentage of oxygen in the flue gas near a predetermined level. In addition, flame and temperature sensors, which can be photoelectric cells and infrared sensors, can be used to detect temperature and the existence of a flame in an area above each of the windboxes, so that combustion gas supplied to each windbox can be individually controlled.

Another problem associated with inefficient combustion of municipal solid waste within a rotary combustor is that of clinker formation. Clinkers, usually consisting of molten ash, softened glass material, etc., can be formed in the combustor and can cause problems in combustor performance. The major cause for the clinker to form is a localized hot spot in the combustor. Due to the varied nature of municipal solid waste, it is not always possible to have a perfectly uniform and even burning fuel bed in the combustor.

Thus, the object of the present invention is to most accurately control the amount of carbon monoxide and unburned hydrocarbons present in the exhaust of a rotary combustor so as to provide for the most efficient combustion of municipal solid waste.

Another object of the present invention is to compensate for changes in the rate of combustion occurring within a rotary combustor due to the variable nature of municipal solid waste.

It is a further object of the present invention to automatically control the combustion rate in a rotary combustor so as to maintain the temperature in the combustor at a stable level which is high enough to complete combustion, but at a level below where the clinker starts to form.

DISCLOSURE OF THE INVENTION

The above objects are obtained by the improved method of the present invention for controlling combustion in a rotary combustor by precisely controlling the supply of combustion gas to six combustion zones of a rotary combustor used for burning municipal solid waste material. The improved method of the present invention comprises the steps of sensing an amount of oxygen present in the exhaust gas to produce an oxygen sensor signal, as well as sensing the temperature within the combustor to produce a temperature sensor signal, and automatically controlling the combustion gas, or air, supplied to three different combustion zones in response to these signals to most accurately maintain the oxygen level in the exhaust gas at a predetermined value. By defining the combustion barrel in terms of three zones, each having two combustion gas supply zones, the most efficient combustion of municipal solid waste material can be achieved by separately and independently controlling the amount of combustion gas supplied to each of these six zones.

BRIEF DESCRIPTION OF THE DRAWINGS

The invention will become more apparent by reading the following detailed description in conjunction with the drawings, which are shown by way of example only, wherein.

DESCRIPTION OF THE PREFERRED EMBODIMENT

Figure 1:
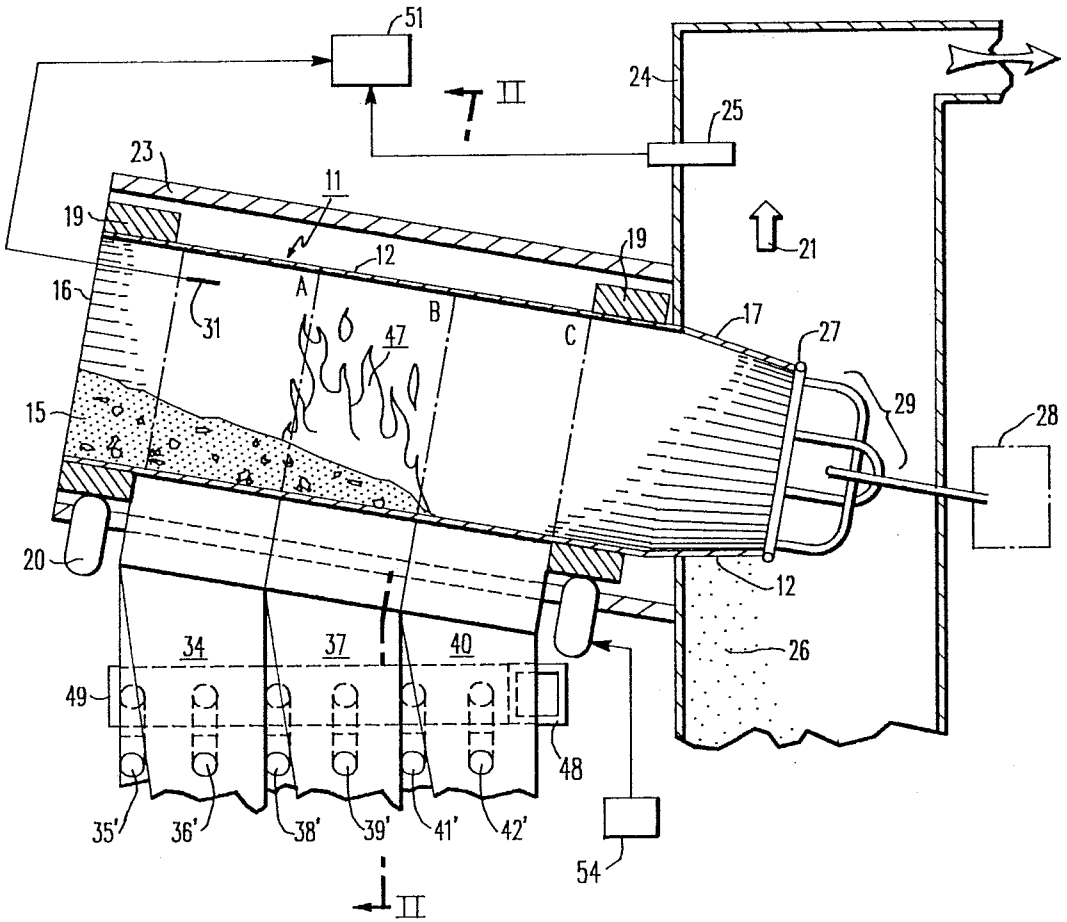
FIG. 1 is a cross-sectional, side-elevational view of a rotary combustor incorporating an improved combustion control method according to the present invention.
Figure 2:
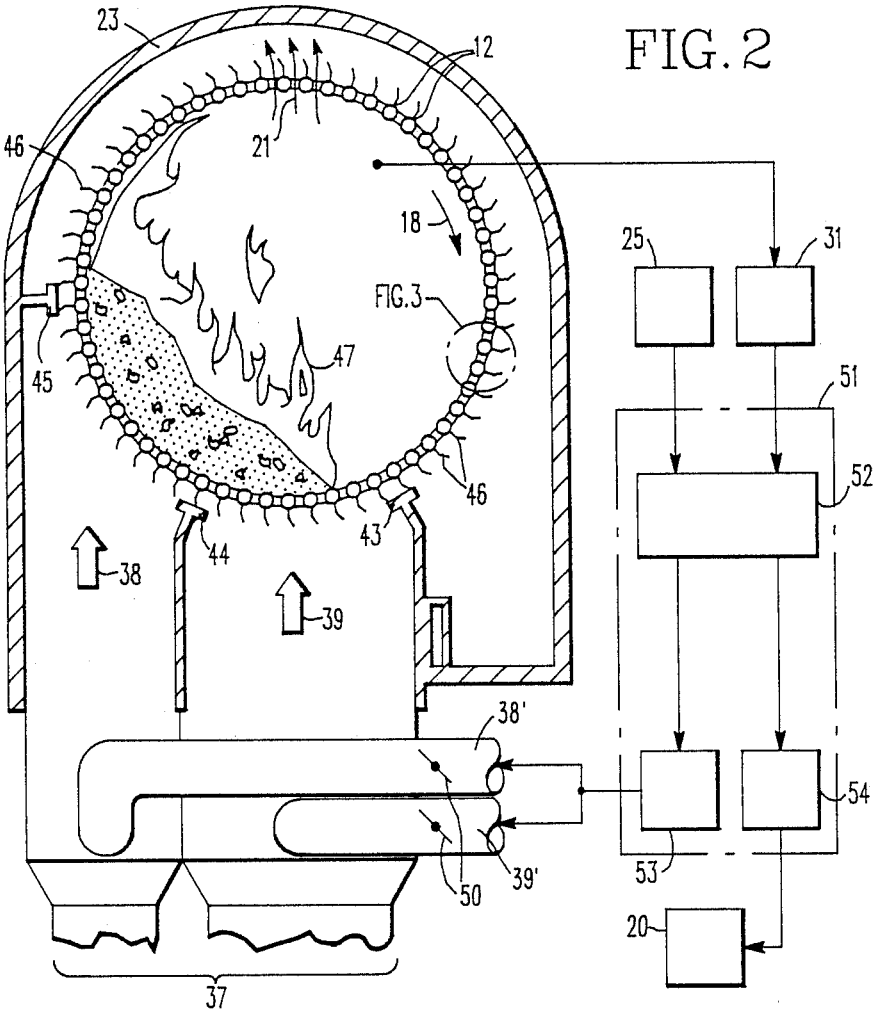
FIG. 2 is a cross-sectional, end-elevational schematic view of the rotary combustor taken along the line II—II in FIG. 1.
Figure 3:
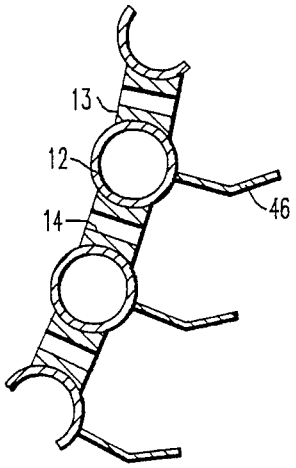
FIG. 3 is an enlargement of a fragmentary segment of the structure of FIG. 2.

A typical rotary combustor, as represented by FIGS. 1, 2, and 3, has as its incineration chamber a generally cylindrical combustion barrel 11 which is comprised of alternating longitudinally extending cooling pipes 12 and perforated web structures 13. The web structures 13 are preferably formed of bar steel and have openings 14 therethrough for supplying combustion gas, preferably air, to the combustion barrel 11. Solid material, particularly municipal solid waste material 15, is burned within the rotating combustion barrel 11. The barrel 11 rotates about its central axis of rotation which is inclined slightly from the horizontal, an input end 16 being slightly higher than an output or exit end 17. As seen from the output end 17 along cross-sectional line II—II, the combustion barrel 11 rotates (in this example) in a clockwise direction as shown by arrow 18, so as to continually mix the waste material 15. This facilitates the drying of relatively wet waste material by continually exposing it to the surface of the fuel bed, where combustion normally takes place. The input 16 and output ends 17 of the combustion barrel 11 are generally encircled by support bands 19 which are received on rotating means, preferably rollers, 20. In this manner the combustion barrel 11 is rotated.

As the waste material is incinerated, the exhaust gases shown by arrows 21 which are thereby generated exit the combustion barrel 11 and are contained within an exhaust area 22 in enclosure 23 (see FIG. 2). Exhaust gases 21 exit the enclosure 23 through a flue 24 located at the output end 17 of the combustor 11 and flow past an oxygen sensor 25. Other, solid combustion products 26, exit the combustion barrel 11 at the output end 17 as well. The slight incline of the combustion barrel 11 facilitates the discharge of these solid combustion products 26.

The cooling pipes 12 have circulating therethrough a coolant, typically water, which enters the cooling pipes 12 from a ring header 27 located at the output end 17 of the combustion barrel 11. The coolant flows towards the input end 16 to a return means (not shown) which returns the coolant, which has been heated by the incineration of the waste material, to the header 27. From the header 27, the high energy coolant is discharged to a heat exchanger or boiler 28 via supply pipe 29. The heat exchanger 28 is connected to a steam driven electrical power generating system (not shown) as is well known in the art. From the heat exchanger 22, low energy coolant reenters the cooling pipes 12 through the ring header 27 forming a closed cycle.

The combustion barrel 11 is generally comprised of three combustion zones, A, B, and C serially disposed lengthwise along the combustion barrel 11, as shown in FIG. 1. The primary function of zone A is to dry the waste material, although combustion is initiated here. Most of the burning of the waste material 15 is accomplished in the middle zone, B. Within zone C, combustion of the solid waste has been essentially completed. A temperature sensing device 31, typically a thermocouple, is preferably located in zone A of the barrel 11. The temperature sensor 31 senses the temperature within the combustion barrel 11, for reasons which are fully explained later in this description.

Disposed beneath each of the three combustion zones A, B, and C, are windboxes 34, 37 and 40, respectively. Each windbox is comprised of an underfire air and overfire air zone, for reasons which will become readily apparent. Combustion gas, or air, is supplied to the combustion barrel 11 through the openings 14 of the perforated web structures 13 via these windboxes 34, 37 and 40. To supply combustion gas or air to the zone B portion of the combustion barrel 11, zone B windbox 37, as shown in FIG. 2, comprises an underfire air zone 38 and an overfire air zone 39, separated by seal box edge portions 43, 44 and 45, disposed to extend lengthwise adjacent the combustion barrel and to cooperate with a plurality of dogleg-shaped seal strips 46 to seal off the various segments of the zone B portion of the windbox 37. Beginning at about five o'clock on the barrel 11 and following in a clockwise direction, the overfire air zone 39 is defined by windbox edges 43 and 44; the underfire air zone 38 by edges 44 and 45. As the solid waste material 15 is consumed by fire, generally indicated at 47, exhaust gases 21 exit the combustion barrel 11 and pass through the flue 24.

Combustion gas is supplied to each of the windboxes 34, 37, and 40 by a blower 48 via air duct 49. Combustion gas is separately supplied to the overfire and underfire air zones 35, 36, 38, 39, 41 and 42 by a corresponding conduit 35', 36', 38', 39', 41' and 42' connected between the air duct 49 and the six zones, each of the conduits having a damper 50 disposed therein. The conduit dampers 50 are the main control means described according to the present invention.

Overfire air is defined as that which flows from the air zones 36, 39, and 42 through the area of openings 14 in the combustion barrel 11 which remains mostly uncovered due to rotational shifting of the waste material 15. It is referred to as overfire air since the combustion gas naturally flows through the uncovered openings over the waste material 15, since that is the path of least resistance. Simultaneously, underfire air is defined as that which flows from the air zones 35, 38, and 41 through the area of openings 14 in the combustion barrel 11 which remain covered by waste material 15. Since the waste material 15 is typically composed of irregularly-shaped objects, the underfire air will filter through the waste material 15 to the surface where combustion is taking place. This facilitates drying of wet waste material 15, particularly in Zone A. Since combustion predominantly occurs in zone B, the underfire air/overfire air distinction generally does not apply in zone C. The importance of this fact will readily become apparent.

According to the present invention and with reference to FIG. 2, the dampers 50 and rotating means 20 are controlled by a control unit 51. The control unit 51 is comprised of a microprocessor 52, windbox damper controller 53 and rotation drive controller 54. Inputs to the control unit 51 are signals from the oxygen sensor 25 disposed within the flue 24 and the temperature sensing device 31, preferably disposed within zone A of the combustion barrel 11. After combustion has been initialized and becomes self-sustaining, the control system will act to maintain a constant rate of combustion.

As the solid waste material 15 burns, exhaust gases 21 exit through the flue 24 and are sensed by the oxygen sensor 25. This produces an oxygen gas sensor signal which is inputted to the control unit 51. The microprocessor 52 of the control unit 51, which can be programmed by one of ordinary skill in the art, responds to the oxygen sensor signal to generate an output signal based upon the percentage of oxygen present in the exhaust gas 21. Different output signals are generated depending upon whether the level of oxygen is above or below some predetermined value in the range of about 4% to 10% by volume, and preferably between about 5% to 8%. The most preferred setting is a function of material being incinerated and is unique for each plant.

Figure 4B:
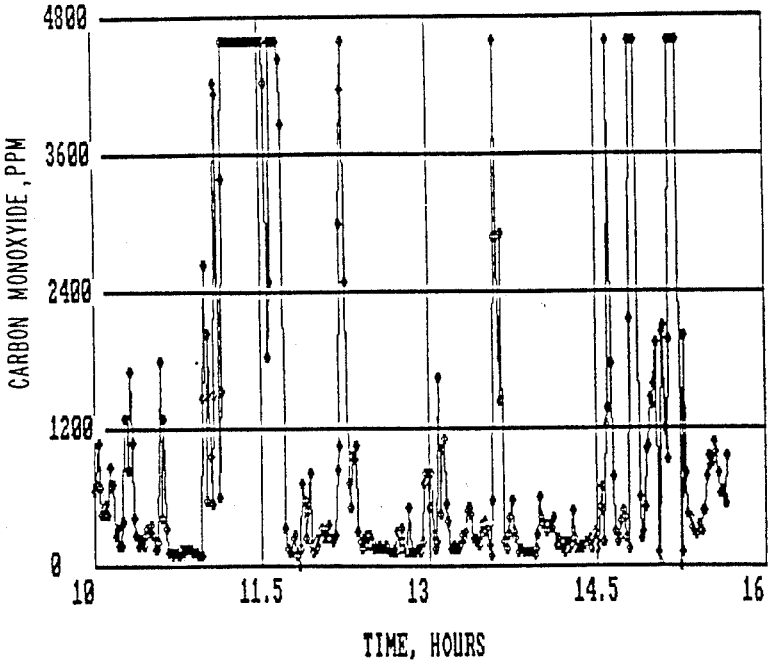
FIG. 4B is a graph of parts per million (ppm) of carbon monoxide in the exhaust gas of a rotary combustor versus time, i.e., the same time as that shown in FIG. 4A.
Figure 4A:
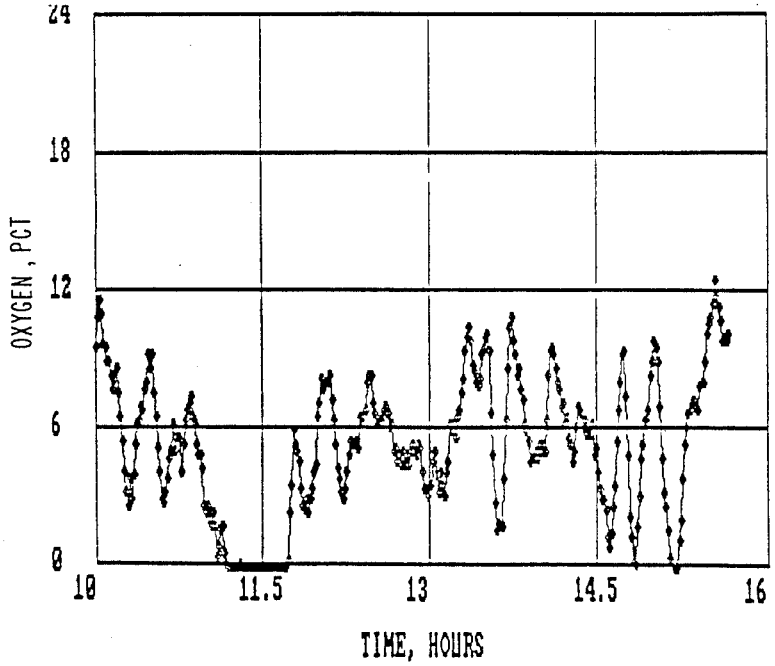
FIG. 4A is a graph of volume percent oxygen in the exhaust gases of a rotary combustor versus time.

There exists a relationship between the amount of oxygen and the amount of carbon monoxide within the exhaust gases 21. This relationship is shown graphically by comparing FIGS. 4A and 4B. So long as the oxygen level is maintained at a level between 4% to 10% by volume the amount of carbon monoxide present in the exhaust gases 21 is virtually non-existent. Since this represents the most efficient combustion of solid waste material 15, a method to more exactly control the amount of carbon monoxide present in the flue gas is desirable. By monitoring the amount of oxygen present in the flue gas in order to determine how much combustion air is to be supplied to the combustor barrel 11, the most efficient burning of municipal waste 15 can be accomplished regardless of its make-up.

The first step to be undertaken when the percentage of oxygen gas in the exhaust 21 is not at the predetermined value at about 5% and 8% is to adjust the airflow into zone C windbox 40. If the oxygen content is below the specified range, airflow into zone C is increased; if oxygen content is above 8%, airflow is decreased. The air distribution between the underfire and overfire air zones is essentially equal in zone C. Since almost no burning of solids occurs in zone C and only gases burn or further combine with oxygen, the effect of inputting more or less air into either zone 41 or 42 is of little consequence. Preferably, the control of air into zone C is done by adjustment of the windbox damper 50 openings. Preferably, the damper openings for underfire 41 and overfire 42 air zones of windbox 40 should have a minimum opening of about 10% and a maximum of about 100%. Although in a second embodiment it may also be accomplished by varying the speed of a fan in blower 48 or by adjusting the blower damper opening, this would also vary the amount of combustion gas being supplied to the zone A windbox 34 and zone B windbox 37. This alternate step, then, requires the simultaneous adjustment of the windbox 34 and 37 damper openings to maintain constant airflow to these two zones. If the second embodiment is chosen, the controller should additionally be programmed to maintain mass flow into the zone A windbox 34 and zone B windbox 37 if adjustment of combustion gas into zone C windbox 40 is performed by adjustment of the blower 48 fan speed or damper opening.

The airflow control into zone C should be sufficient to bring the oxygen level in the exhaust gas 21 to the setpoint of between about 4% to 10% by volume in the flue 24. If the burning rate in the combustion barrel 11 is either too high or too low to be able to control the oxygen level by controlling the supply of combustion gas to zone C alone, the windbox controller 53 is commanded by the microprocessor 52 to go on to the next step.

The following steps described below are designed to reduce the demand for oxygen in the combustion barrel 11 by limiting the combustion gas supply into the area where active combustion is taking place. Usually gas phase combustion is actively taking place in zone B, but sometimes waste material 15 in zone A may be burning. By limiting combustion gas supply in zones A and B, especially as between underfire 35, 38 and overfire 36, 39 air zones, combustion rate decreases very quickly and demand for oxygen falls off immediately thereby increasing its percentage level within the exhaust 21. Conversely, when additional combustion gas is supplied to zones A and B, the burning rate of the solid waste material 15 increases and, as a corresponding result, the percentage of oxygen in the exhaust gas 21 decreases.

Using the signal from the oxygen sensor 25, the microprocessor 52 directs the windbox controller 53 to automatically control the supply of combustion gas to the zone B windboxes 38 and 39 as follows: If the oxygen level of the exhaust gas 21 is below about 5%, and preferably if it is below about 4.5%, the supply of combustion gas to this zone should be decreased; and if the oxygen level is above about 8%, the combustion gas supplied to zone B should be increased. This adjustment is made by varying the damper 50 openings. If the adjustment of air to zone C was made by adjusting the blower 48 fan or damper, then this is especially true. Preferably, the control of combustion gas supplied to zone B consists of supplying a greater percentage of combustion gas to the underfire air zone 38 than the overfire air zone 39, on the order of 60% to 40%, since the underfire air has more of an influence on the combustion rate. The minimum and maximum damper openings for zone B underfire 38 and overfire 39 air zones should preferably be about 10% and 80%, respectively.

If the two preceding steps do not bring the oxygen level to the setpoint, then the windbox controller 53 is directed by the microprocessor 52 to perform the following step: If the oxygen level, as indicated by the oxygen sensor 25, is above about 8.5%, then the supply of combustion gas to zone A is increased; or if the oxygen level is below about 4%, then less combustion gas or air is supplied to zone A. Preferably, the windbox controller 53 performs this step by adjusting the supply of combustion gas to the zone A overfire air zone 36, in dependence upon the oxygen sensor signal. The zone A overfire air zone 36 preferably has a maximum damper opening of about 50%, and a minimum limit of about 0%. The supply of combustion gas to the zone A underfire air zone 35 is controlled by the signal received by the microprocessor 52 from the temperature sensing device 31. The purpose of this step is to input combustion gas into the zone A underfire windbox 35 to facilitate the drying of very wet solid waste material 15.

Zone A underfire air zone 35 damper opening should have a minimum and maximum opening and corresponding combustion gas flow rate inversely proportional to the combustion barrel temperature sensing device 31 reading. Thus, if the temperature sensing device 31 produces a signal above a predetermined setpoint, which setpoint will be unique for each plant, the supply of combustion gas to the underfire air zone 35 is decreased, and it is automatically increased if the signal is below a predetermined temperature setting. Generally the temperature should be maintained at a setpoint in the range of 1100° C. (2000° F.); however it should be understood that the setpoints are dependent upon the device's location within the combustion barrel 11 as well as the size of the combustor itself.

As an additional step, the rate of rotation of the combustion barrel 11 can be adjusted as well. This step would be necessary if the above steps do not result in the level of oxygen in the exhaust gas 21 being maintained within the predetermined range of between about 5% and 8%, most preferably at about 6.5% by volume. This may occur in the case of very wet waste material 15, wherein the oxygen level would be above 8%; or in the case where the rate of rotation, shown by arrow 18, had been previously increased and now drier waste material 15 is being incinerated in the combustion barrel 11 and the oxygen level is below 5%. Since combustion takes place at the surface of the continually rotating waste material 15, a faster rotational speed will increase the combustion rate because new material 15 is continually exposed to the fire 47. In the case of very wet waste material 15, a faster rotational speed will dry the material more quickly when exposed to the fire 47 at the surface, along with the drying action accomplished by the additional air previously inputted through the zone A underfire air zone 35.

The control of the rate of rotation of the combustion barrel 11 is based upon the output signal from the temperature sensing device 31. Dry waste material will burn at a higher temperature than wet waste material. If the temperature within the combustion barrel 11 is above the predetermined temperature setting, as determined by the temperature sensing device 31, the rotation controller 54 will be directed by the microprocessor 52 to decrease the rate of rotation of the rotating means 20 and thus the combustion barrel 11. A slower rotational speed will cause less material 15 to be exposed to the surface and thereby slow the combustion rate, so that combustion mainly takes place in zone B. Conversely, if the temperature within the combustion barrel 11 is too low, indicating the presence of wet waste material, the rotation controller 54 will increase the rate of rotation of the combustion barrel 11 to dry the wet waste material and increase the rate of combustion, since more waste material 15 will be exposed to the surface to thereby dry the wet waste material and increase combustion rate.

Figure 5:
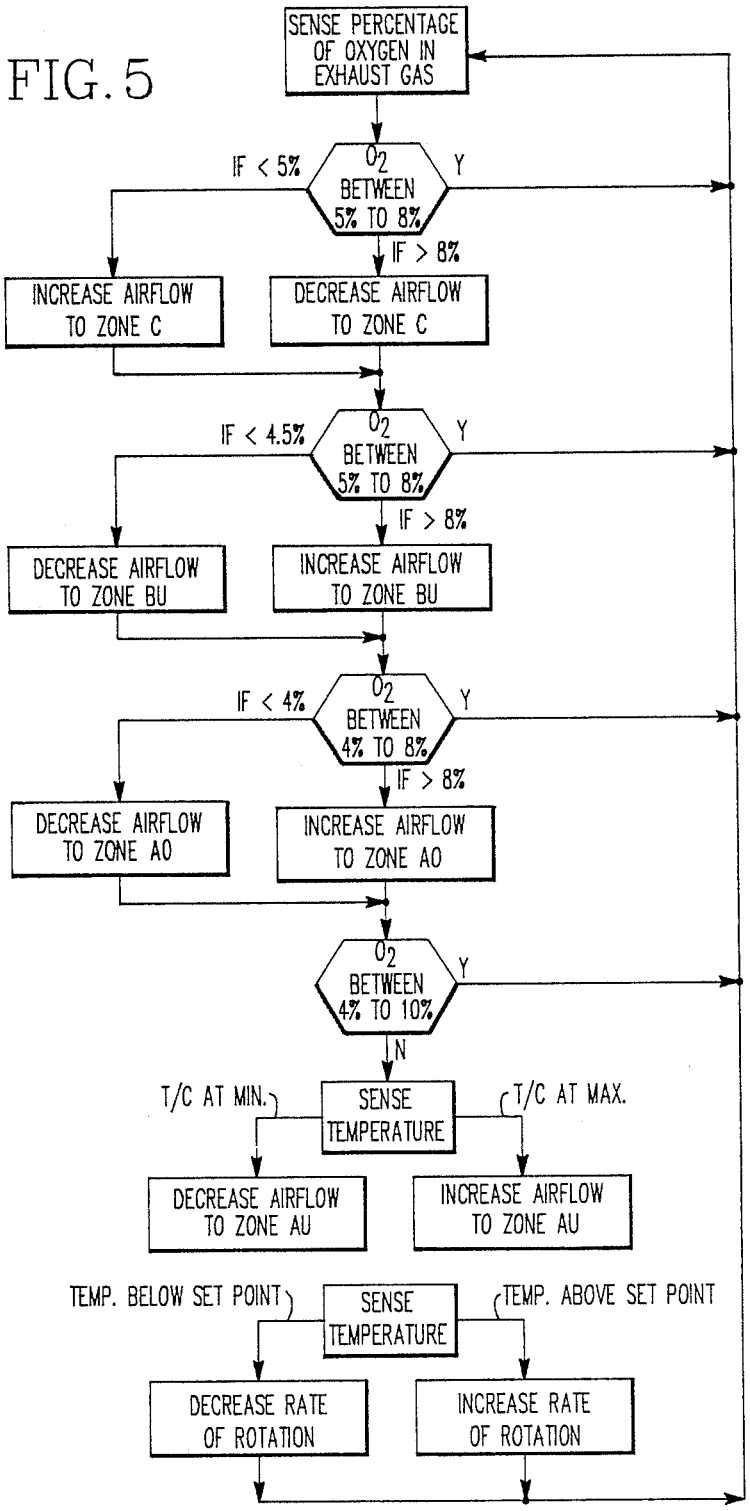
FIG. 5 is a flow chart outlining the successive steps taken by the combustion controller to most efficiently control combustion.

The amount of air to be inputted into each zone, or increase/decrease in rate of rotation, necessary to maintain a more stable combustion rate is dependent upon how great a deviation from the predetermined setpoints of the sensors is detected. Since these parameters are a function of combustor size as well, each incineration plant requires the defining of unique parameters. However, by performing these precise steps according to the present invention as represented in the flow chart of FIG. 5, based solely upon the output signals produced by the oxygen sensor 25 and the temperature sensor 31, the combustion rate of solid municipal waste material 15 can be most efficiently controlled, regardless of its varied composition over time, especially as to moisture content, so as to maintain the level of carbon monoxide and unburned hydrocarbons in the exhaust well below statutory requirements. The improved control method is able to maintain the temperature in the combustor at a level which is high enough to complete the combustion, but at a level below where the clinker starts to form regardless of combustor size. In addition the method minimizes temperature fluctuations, which may initiate the clinker build-up, once combustion in the combustor has become self-sustaining. Also, a more stable combustion rate will result independent of feed rate, thereby preventing clinker formation. In this manner, the volume of solid waste material can be reduced by over 90% in a clean and efficient method.

While specific embodiments of the invention have been described in detail, it will be appreciated by those skilled in the art that various modifications and alterations to those details would be developed in light of the overall teachings of the disclosure. Accordingly, the particular arrangements disclosed are meant to be illustrative only and not limiting as to the scope of the invention which is to be given the full breadth of the appended claims and in any and all equivalents thereof.

What is claimed is:

1. A method of automatically controlling combustion in a rotary combustor having a rotating combustion barrel in which solid waste material is burned by air supplied to the barrel through holes disposed throughout its length and periphery, the air being supplied through a plurality of ducts into three portions of the barrel, an inlet portion adjacent the end into which solid waste is introduced into the barrel, an outlet portion disposed adjacent the end from which exhaust gases exit the barrel and an intermediate portion disposed between the inlet and outlet portions, the ducts being further divided to supply both underfired air and overfired air to each portion of the barrel, said method comprising the steps of:

individually varying the overfired and underfired air to each portion of the barrel in response to changes in the temperature in the barrel and changes in the percent of oxygen in exhaust gases; and varying the speed at which the barrel rotates in response to changes in the temperature in the barrel to provide generally complete combustion of the solid waste at a temperature which prevents clinker formation within the barrel.

2. The method as recited in claim 1, wherein the step of individually varying the air to each portion of the barrel includes varying the underfired air in outlet portion in response to temperature changes in the barrel and, varying the rotational speed of the barrel in order to maintain a predetermined temperature in the barrel.

3. The method as recited in claim 2, wherein the predetermined temperature is generally 1110° C.

4. The method as recited in claim 1, wherein the step of individually varying the air to each portion of the barrel comprises varying in a predetermined order overfired air to the outlet portion of the barrel, underfired air to the intermediate portion of the barrel, and air flow to the inlet portion of the barrel, in order to bring the oxygen in the exhaust gases within predetermined limits.

5. The method as recited in claim 4, wherein the predetermined limits of oxygen in the exhaust gases is generally between 4 to 10 percent by volume.

6. The method as recited in claim 1, wherein the step of individually varying the air to each portion of the barrel comprises varying the air serially starting with varying the overfired air to the outlet portion of the barrel then varying the underfired air to the intermediate portion of the barrel and then varying the air flow to the inlet portion of the barrel in order to bring the oxygen in the exhaust gases within predetermined limits.

7. The method as recited in claim 6, wherein the predetermined limits of oxygen in the exhaust gases is generally between 4 to 10 percent by volume.

8. A rotary combustor for burning solid waste material, the combustor having a gas porous combustion barrel coupled to a rotation means, combustion gas being supplied to the combustion barrel through a plurality of ducts into three zones of the combustion barrel, an inlet zone adjacent the end into which solid waste is introduced into the barrel, an outlet zone disposed adjacent the end from which exhaust gases exit the barrel, and an intermediate zone disposed between the inlet and outlet zones, the ducts being further divided to supply both underfired combustion gas and overfired combustion gas to each zone of the barrel, the rotary combustor having a combustion controller comprising:

an oxygen sensor for producing a signal indicative of a percentage of oxygen in the exhaust gas;

a temperature sensor disposed within the combustor barrel for producing a signal indicative of temperature therein; and an automatic control means for controlling a quantity of combustion gas supplied to each of said three zones of the combustion barrel in response to the oxygen sensor signal and the temperature sensor signal to maintain the percentage of oxygen in the exhaust gas at a predetermined value and to prevent clinker formation.

9. The rotary combustor as recited in claim 8, wherein the automatic control means is comprised of:

a processing means for comparing the oxygen sensor signal within a predetermined oxygen level, thereby producing a first signal indicating that the percentage of oxygen is outside the predetermined oxygen level, and for comparing the temperature sensor signal with a predetermined temperature level, thereby producing a second signal indicating that the temperature within the combustion barrel is outside the predetermined temperature level;

a duct damper controller, operatively connected to the processing means, for converting the first and second outputs of the processing means into mechanical movement; and an air duct disposed to supply combustion gas to each of the six underfire and overfire air zones of said three zones by six corresponding conduits and a damper disposed in each conduit for controlling the quantity of combustion gas supplied to said three zones of the combustion barrel.

10. The rotary combustor as recited in claim 9, wherein said dampers are separately and sequentially controlled to separately supply combustion gas to each underfire and overfire air zone, beginning with the outlet zone.

11. The rotary combustor as recited in claim 9, wherein the temperature sensor is disposed in the inlet zone.

12. The rotary combustor as recited in claim 11, wherein the automatic control means is further comprised of a rotation controller operatively connected to the processing means and the rotating means for controlling the rate of rotation of the combustion barrel.

13. The rotary combustor as recited in claim 12, wherein the rotation controller responds to the temperature sensor signal to decrease the rate of rotation when the temperature is below the predetermined temperature level, and to increase the rate of rotation when the temperature is above the predetermined temperature level.

* * * * *